US008505135B2

(12) United States Patent
Zeng

(10) Patent No.: US 8,505,135 B2
(45) Date of Patent: Aug. 13, 2013

(54) BEDRIDDEN PATIENT TRANSFER GURNEY

(75) Inventor: Xianhui Zeng, Guangdong (CN)

(73) Assignee: Zhaoxiang Zeng, Guangzhou (CN)

( * ) Notice: Subject to any disclaimer, the term of this patent is extended or adjusted under 35 U.S.C. 154(b) by 85 days.

(21) Appl. No.: 13/143,971

(22) PCT Filed: Dec. 28, 2009

(86) PCT No.: PCT/CN2009/076117
§ 371 (c)(1),
(2), (4) Date: Jul. 18, 2011

(87) PCT Pub. No.: WO2010/078810
PCT Pub. Date: Jul. 15, 2010

(65) Prior Publication Data

US 2011/0258774 A1 Oct. 27, 2011

(30) Foreign Application Priority Data

Jan. 9, 2009 (CN) ..... 2009 2 0049909 U

(51) Int. Cl.
*A61G 7/10* (2006.01)

(52) U.S. Cl.
USPC ..... 5/83.1; 5/87.1; 5/85.1

(58) Field of Classification Search
USPC ..... 5/81.1 R, 83.1, 85.1, 86.1, 87.1, 5/89.1
See application file for complete search history.

(56) References Cited

U.S. PATENT DOCUMENTS

| | | | | |
|---|---|---|---|---|
| 245,502 | A * | 8/1881 | Jacobson | 27/28 |
| 2,125,546 | A * | 8/1938 | Corr | 5/86.1 |
| 2,975,434 | A * | 3/1961 | Butler et al. | 5/86.1 |
| 3,131,404 | A * | 5/1964 | Bowers et al. | 5/86.1 |
| 3,469,269 | A * | 9/1969 | Brown | 5/86.1 |
| 4,837,874 | A * | 6/1989 | Giercarz et al. | 5/84.1 |
| 5,283,917 | A * | 2/1994 | Dietze | 5/83.1 |
| 2010/0000015 | A1 * | 1/2010 | Althaus | 5/83.1 |

FOREIGN PATENT DOCUMENTS

| | | |
|---|---|---|
| CN | 2279906 | 4/1998 |
| CN | 2395714 | 9/2000 |
| CN | 2533834 | 2/2003 |
| CN | 2730354 | 10/2005 |
| CN | 1903154 | 1/2007 |

(Continued)

OTHER PUBLICATIONS

International Search Report for international application No. PCT/CN2009/076117, dated Mar. 11, 2010 (6 pages).

*Primary Examiner* — Michael Trettel
(74) *Attorney, Agent, or Firm* — Hamre, Schumann, Mueller & Larson, P.C.

(57) ABSTRACT

A bedridden patient transfer gurney is provided, which includes a gurney body, and further includes several support feet installed with a swivel caster at the bottom. A top end of each support foot is connected to the gurney body. An elevation device is disposed on the support foot. Two curved panels opposite to each other having a shape of a grab bucket are disposed at a lower portion of the gurney body. When being closed, the two curved panels are capable of accommodating a human body. An opening and closing device is disposed between the gurney body and the two curved panels. The opening and closing device is respectively connected to the gurney body and the two curved panels. The bedridden patient transfer gurney is used for transferring a bedridden patient, has a simple structure and an advantage of convenient use, and ensures good stability when the patient is being transferred, thereby preventing the patient from experiencing more pain.

5 Claims, 3 Drawing Sheets

(56) References Cited

FOREIGN PATENT DOCUMENTS

| | | |
|---|---|---|
| CN | 2912581 | 6/2007 |
| CN | 200948204 | 9/2007 |
| CN | 200977244 | 11/2007 |
| CN | 201046201 | 4/2008 |
| CN | 201157469 | 12/2008 |

* cited by examiner

BEDRIDDEN PATIENT TRANSFER GURNEY

BACKGROUND OF THE UTILITY MODEL

1. Field of Utility Model

The utility model relates to a medical appliance, and more particularly to a bedridden patient transfer gurney that facilitates healthcare personnel to move a patient.

2. Related Art

At present, when healthcare personnel in a hospital need to move a bedridden patient very often during nursing, examination, or treatment of the patient. In a conventional manner, a number of healthcare personnel or relatives of the patient roll over or raise the bedridden patient together with hands, and then change sheets or transfer the patient onto the gurney. This movement manner is very difficult for both the healthcare personnel and the patient, especially for patients who have fracture of shank or vertebra or become bedridden after operation. On one hand, unhealed wounds of the patient might be dragged, causing great pain to the patient or even causing re-injury. On the other hand, high labor intensity is required for the healthcare personnel, and a number of people are required for help.

In order to change this situation, persons skilled in the art have made a lot of researches, and at the same time proposed many patent applications. For example, a "TRANSLATIONAL PATIENT MOVEMENT APPARATUS" is disclosed in China Patent No. ZL99240571.8 (Publication No.: CN2395714Y, and Publication Date: Sep. 13, 2000). In the technical solution, rollers are disposed inside a flexible rotary cushion, and the rollers are rotated by a sprocket mechanism to move the flexible cushion. In use, a patient needs to be rolled to one side. The flexible cushion is placed under the body of the patient. The patient is then made to lie on the flexible cushion. The rollers are rotated to realize translation of the patient. Although parallel movement of the patient can be realized, the patient still needs to be rolled to one side, and during the parallel movement, the stability of the patient is poor, so the apparatus is difficult to use. For example, a "PATIENT MOVING DEVICE" disclosed in China Patent No. ZL01 277455.3 (Publication No.: CN2533834Y, and Publication Date: Feb. 5, 2003). In the technical solution, posts and a lifting mechanism are disposed at the sides of a common moving bed. A patient is held and lifted through an iron ring combination capable of opening and closing, so as to realize the transfer of the patient. In the patent, the manual lifting and movement require operations of a number of people. The structure of the iron ring combination has small contact areas with the back of the patient, which easily causes pain to the patient. Therefore, the device is also difficult to use. For example, a "HOISTING OPERATION MOVING GURNEY" is disclosed in China Patent No. ZL200420064433.5 (Publication No.: CN2730354Y, and Publication Date: Oct. 5, 2005). In the technical solution, two sets of lifting mechanisms are disposed, and scrolls and struts are disposed on the lifting mechanism. The sheet is wound by using the scrolls and struts, pressed, and fixed, so as to form a state of a stretcher to move a patient after operation, thereby transferring the patient who just has had an operation from an operating table to a hospital bed. However, the sheet being directly used for transferring has the sanitary problem, and the use range thereof is limited. For example, a "BED-CHANGING GURNEY" is disclosed in China Patent No. ZL200620076561.0 (Publication No.: CN200948204Y, and Publication Date: Sep. 19, 2007). In the technical solution, a bed body with an elevation device and installed with swivel casters is provided, and a bed board capable of parallel sliding is disposed on the bed body, so a patient can be easily moved from the gurney to the bed or from the bed to the gurney. In the technical solution, the patient still needs to be rolled to one side, so the gurney is also difficult to use. For example, a "MEDICAL PATIENT TRANSFER GURNEY" is disclosed in China Patent Application No. 200610052776.3 (Publication No.: CN1903154A, and Publication Date: Jan. 31, 2007). In the technical solution, on a gurney body with an elevation mechanism and installed with swivel casters, double layers of a movement panel and a movement cloth are disposed on the bed body, so a force of friction as the body bed is inserted under the body of the patient is reduced through the opposite movement between the movement cloth and the movement panel, such that the movement panel can easily go under the body of the patient, thereby realizing transfer of the patient. In the technical solution, a large number of movement parts exist, the structure is complicated, and the whole equipment has a high manufacturing cost, such that the popularity and application thereof are not as high as predicted. In conclusion, the conventional equipment for moving patients is inconvenient to use.

SUMMARY OF THE UTILITY MODEL

The utility model is directed to a bedridden patient transfer gurney that has a simple structure, is convenient to use, and has good stability when a patient is being moved.

In order to solve the technical problems, the utility model adopts the following technical solution.

A bedridden patient transfer gurney is provided, which includes a gurney body, and further includes several support feet installed with a swivel caster at the bottom. A top end of each support foot is connected to the gurney body. An elevation device is disposed on the support foot. Two curved panels opposite to each other having a shape of a grab bucket are disposed at a lower portion of the gurney body. When being closed, the two curved panels are capable of accommodating a human body. An opening and closing device is disposed between the gurney body and the two curved panels. The opening and closing device is respectively connected to the gurney body and the two curved panels.

In the technical solution, the gurney body has a cuboid shape and four support feet are provided.

In the technical solution, the elevation device is disposed at a lower portion of the support feet. The elevation device is an electric elevator. A storage battery for supplying power to the elevation device is further installed on the support foot.

In the technical solution, the opening and closing device is formed of an installation box, two gas springs, a vertical connecting rod, and two inclined connecting rods. The installation box is fixedly connected to the gurney body. Upper portions of the two curved panels are respectively hinged to a sidewall of the installation box. One end of each of the two gas springs is hinged to an inner wall of the installation box. The other end of each of the two gas springs is hinged to a top end portion of the vertical connecting rod. A lower end portion of the vertical connecting rod is hinged to an end portion of each of the two inclined connecting rods. The other end portion of each of the two inclined connecting rods is respectively hinged to a corresponding lug fixed on each of the two curved panels. When the structure is used, the healthcare personnel are required to open or close the two curved panels by hands.

In the technical solution, the opening and closing device is formed of an installation box, an electric pushrod, and two inclined connecting rods. The installation box is fixedly connected to the gurney body. Upper portions of the two curved panels are respectively hinged to a sidewall of the installation box. A top end portion of the electric pushrod is fixed at an inner top portion of the installation box. A lower portion of the electric pushrod is hinged to an end portion of each of the two inclined connecting rods. The other end portion of each of the two inclined connecting rods is respectively hinged to a corresponding lug fixed on each of the two curved panels. When the structure is used, the two curved panels can be directly opened or closed by using the electric pushrod, which is more convenient.

In the technical solution, opposite lower inner sides of the two curved panels incline downward. Therefore, the two curved panels can be inserted under the back of the patient more easily.

When the structure is adopted in the utility model, the two curved panels can be directly inserted under the back of a bedridden patient, and the two curved panels are then closed, such that the bedridden patient is vertically lifted and moved. The utility model has a simple structure, is easy to use, has good stability when a patient is being moved, and prevents the patient from experiencing more pain, so as to provide a bedridden patient transfer apparatus for hospitals.

After reading the detailed illustration of the embodiments of the utility model with reference to the accompanying drawings, the features and advantages of the utility model become much clearer.

BRIEF DESCRIPTION OF THE DRAWINGS

The present utility model will become more fully understood from the detailed description given herein below for illustration only, and thus are not limitative of the present utility model, and wherein.

Figure 1:
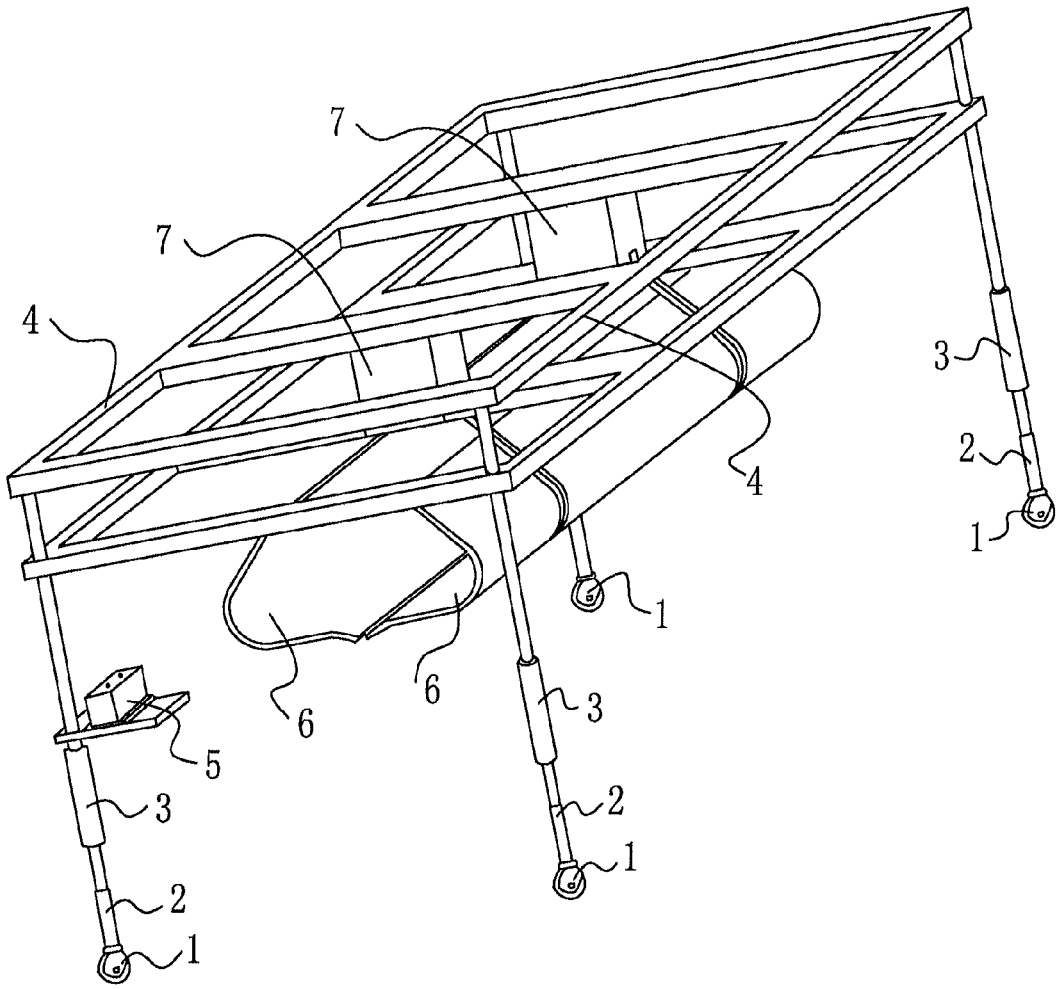
FIG. 1 is a schematic 3D structural view according to an embodiment of the utility model.

In the drawings: 1, Swivel caster; 2, Support foot; 3, Elevation device; 4, Gurney body; 5, Storage battery; 6, Curved panel; 6*a*, Lug; 7, Opening and closing device; 7*a*, Installation box; 7*b*, Gas spring; 7*c*, Vertical connecting rod; 7*d*, Inclined connecting rod; and 7*e*, Electric pushrod.

DETAILED DESCRIPTION OF THE UTILITY MODEL

The utility model is further illustrated in detail with reference to an embodiment. However, it should be noted that the protection scope of the utility model is not limited thereto.

Figure 2:
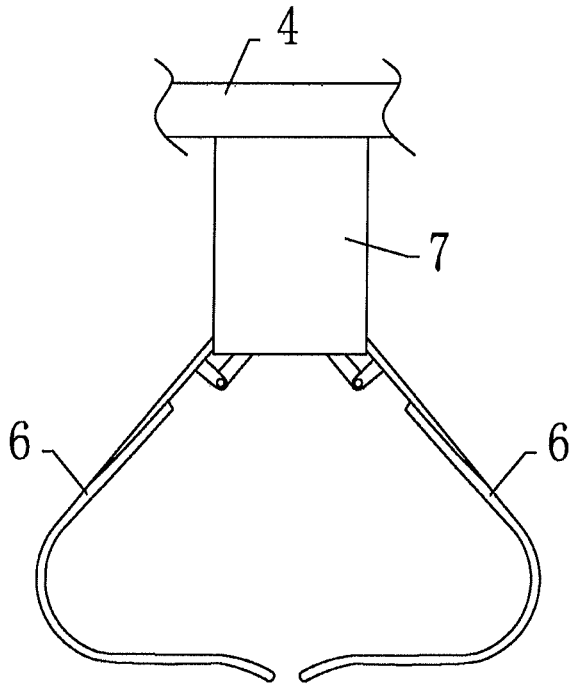
FIG. 2 is a schematic structural view when two curved panels are closed according to the utility model.
Figure 3:
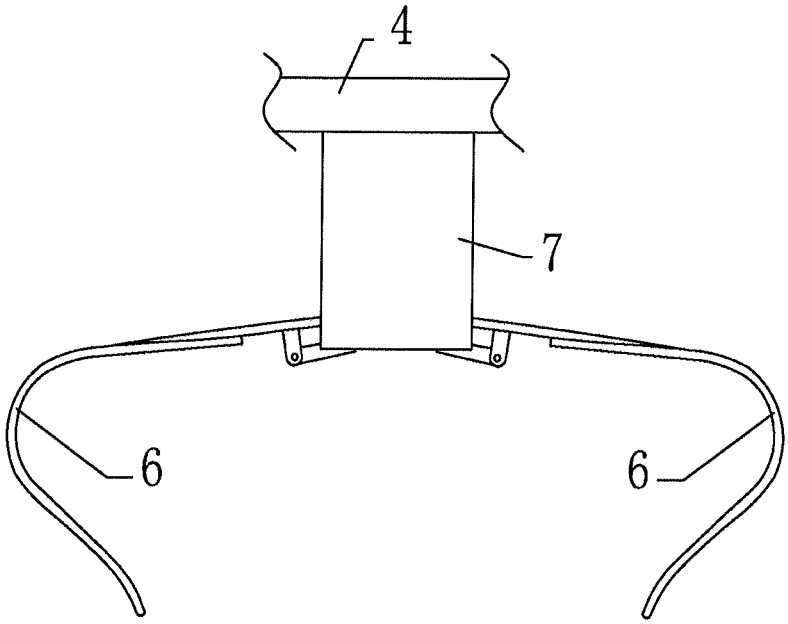
FIG. 3 is a schematic structural view when two curved panels are opened according to the utility model.

Refer to FIG. 1, FIG. 2, and FIG. 3. A bedridden patient transfer gurney includes a cuboid gurney body 4 and four support feet 2 installed with a swivel caster 1 at the bottom. A top end of each support foot 2 is connected to the gurney body 4. An elevation device 3 is disposed at a lower portion of the support foot 2. The elevation device 3 is an electric elevator. A storage battery 5 for supplying power to the elevation device 3 is further installed on the support foot 2. The elevation device 3 can be used to elevate the support feet 2, so that the patient is vertically lifted and moved away from the hospital bed. Two curved panels 6 opposite to each other having a shape of a grab bucket are disposed at a lower portion of the gurney body 4. When being closed, the two curved panels 6 are capable of accommodating a human body. Opposite lower inner sides of the two curved panels 6 incline downward, so the two curved panels 6 can be inserted under the back of the patient more easily without touching the patient. Two sets of opening and closing devices 7 are disposed between the gurney body 4 and the two curved panels 6. The opening and closing device 7 is respectively connected to the gurney body 4 and the two curved panels 6. The opening and closing devices 7 are used for opening and closing the two curved panels 6.

Figure 4:
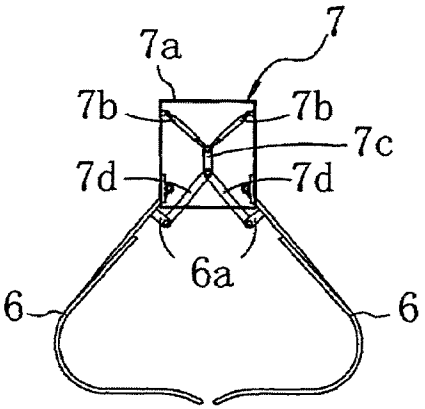
FIG. 4 is a schematic structural view when an opening and closing device is closed according to a specific embodiment of the utility model.
Figure 5:
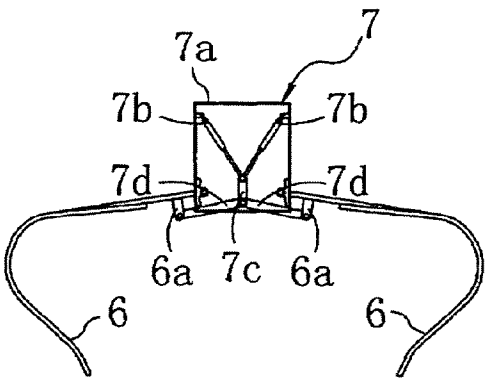
FIG. 5 is a schematic structural view when an opening and closing device is opened according to a specific embodiment of the utility model.

Refer to FIG. 4 and FIG. 5. The opening and closing device 7 may be formed of an installation box 7*a*, two gas springs 7*b*, a vertical connecting rod 7*c*, and two inclined connecting rods 7*d*. The installation box 7*a* is fixedly connected to the gurney body 4. Upper portions of the two curved panels 6 are respectively hinged to a sidewall of the installation box 7*a*. One end of each of the two gas springs 7*b* is hinged to an inner wall of the installation box 7*a*. The other end of each of the two gas springs 7*b* is hinged to a top end portion of the vertical connecting rod 7*c*. The lower end portion of the vertical connecting rod 7*c* is hinged to an end portion of each of the two inclined connecting rods 7*d*. The other end portion of each of the two inclined connecting rods 7*d* is respectively hinged to a corresponding lug 6*a* fixed on the two curved panels 6. In use, the healthcare personnel can control an open state and a closed state of the two curved panels 6 by using the two gas springs 7*b*. However, manual force is required.

Figure 6:
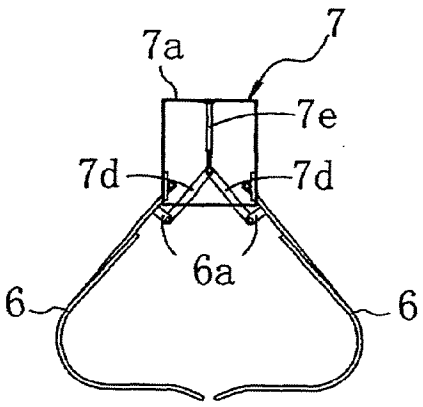
FIG. 6 is a schematic structural view when an opening and closing device is closed according to another specific embodiment of the utility model.
Figure 7:
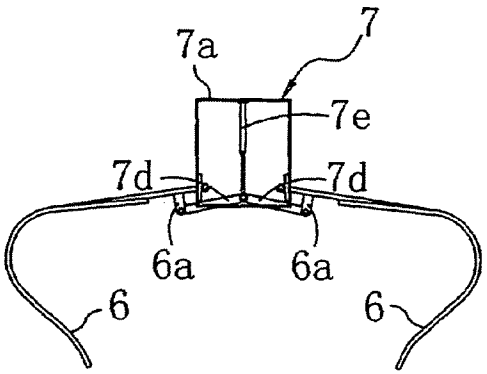
FIG. 7 is a schematic structural view when an opening and closing device is opened according to another specific embodiment of the utility model.

Refer to FIG. 6 and FIG. 7. The opening and closing device 7 may also be formed of an installation box 7*a*, an electric pushrod 7*e*, and two inclined connecting rods 7*d*. The installation box 7*a* is fixedly connected to the gurney body 4. Upper portions of the two curved panels 6 are respectively hinged to a sidewall of the installation box 7*a*. A top end portion of the electric pushrod 7*e* is fixed at an inner top portion of the installation box 7*a*. A lower portion of the electric pushrod 7*e* is hinged to an end portion of each of the two inclined connecting rods 7*d*. The other end portion of each of the two inclined connecting rods 7*d* is respectively hinged to a corresponding lug 6*a* fixed on the two curved panels 6. In use, the healthcare personnel can open and close the two curved panels 6 by moving the electric pushrod 7*e* up and down.

In the practical application of the embodiment, the gurney body 4 is first pushed onto a hospital bed or other medical equipment. As the gurney body 4 has a cuboid shape, the top ends of the support feet 2 can be connected to the peripheral of the gurney body 4, so that the gurney body 4 can be pushed above the hospital bed or other positions where a patient is lying (for example, when CT or X-ray is just finished). Next, the elevation device 3 is used to make the two curved panels 6 at a proper height. The two curved panels 6 are opened outward. Subsequently, the elevation device 3 is used to move the two curved panels 6 down to proper positions, so when being closed, the two curved panels 6 are just under the back of the patient. Next, the elevation device 3 is used to lift the two curved panels 6 that hold the patient, such that the healthcare personnel can replace sheets or move the patient to a desired place.

Although the embodiment of the utility model is described with reference to the accompanying drawings, persons skilled in the art can make various variations or modifications without departing from the scope as defined by the claims, and all the variations and modifications shall fall within the protection scope of the utility model as long as the variations and modifications do not depart from the protection scope as defined by the claims of the utility model.

What is claimed is:

1. A bedridden patient transfer gurney, comprising a gurney body, and further comprising several support feet installed with a swivel caster at a bottom, wherein a top end of each support foot is connected to the gurney body, and an elevation device is disposed on the support foot;

two curved panels opposite to each other having a shape of a grab bucket are disposed at a lower portion of the gurney body, the two curved panels being capable to close, forming a space to accommodate a human body; and an opening and closing device is disposed between the gurney body and the two curved panels, and the opening and closing device is respectively connected to the gurney body and the two curved panels, wherein the opening and closing device is formed of an installation box, two gas springs, a vertical connecting rod, and two inclined connecting rods, the installation box is fixedly connected to the gurney body, and upper portions of the two curved panels are respectively hinged to sidewalls of the installation box, and one end of each of the two gas springs is hinged to an inner wall of the installation box, the other end of each of the two gas springs is hinged to a top end portion of the vertical connecting rod, a lower end portion of the vertical connecting rod is hinged to an end portion of each of the two inclined connecting rods, and the other end portion of each of the two inclined connecting rods is respectively hinged to a corresponding lug fixed on each of the two curved panels.

2. The bedridden patient transfer gurney according to claim 1, wherein the gurney body has a cuboid shape, and four support feet are provided.

3. The bedridden patient transfer gurney according to claim 1, wherein the elevation device is disposed at a lower portion of the support feet, the elevation device is an electric elevator; and a storage battery for supplying power to the elevation device is further installed on the support foot.

4. A bedridden patient transfer gurney, comprising:

a gurney body, and further comprising several support feet installed with a swivel caster at a bottom, wherein a top end of each support foot is connected to the gurney body, and an elevation device is disposed on the support foot;

two curved panels opposite to each other having a shape of a grab bucket are disposed at a lower portion of the gurney body, the two curved panels being capable to close, forming a space to accommodate a human body; and an opening and closing device is disposed between the gurney body and the two curved panels, and the opening and closing device is respectively connected to the gurney body and the two curved panels, wherein the opening and closing device is formed of an installation box, an electric pushrod, and two inclined connecting rods the installation box is fixedly connected to the gurney body, upper portions of the two curved panels are respectively hinged to a sidewall of the installation box, and a top end portion of the electric pushrod is fixed at an inner top portion of the installation box, a lower portion of the electric pushrod is hinged to an end portion of each of the two inclined connecting rods, and the other end portion of each of the two inclined connecting rods is respectively hinged to a corresponding lug fixed on each of the two curved panels.

5. The bedridden patient transfer gurney according to claim 1, wherein opposite lower inner sides of the two curved panels incline downward.

* * * * *